United States Patent [19]

Kondo

[11] 4,104,863

[45] Aug. 8, 1978

[54] ELECTRONIC TIMEPIECE HAVING AN ALARM DEVICE

[75] Inventor: Kenichi Kondo, Tokyo, Japan

[73] Assignee: Kabushiki Kaisha Daini Seikosha, Japan

[21] Appl. No.: 743,500

[22] Filed: Nov. 19, 1976

[30] Foreign Application Priority Data

Nov. 22, 1975 [JP] Japan ..... 50-140478

[51] Int. Cl.[2] ..... G04C 21/00; G04B 23/12

[52] U.S. Cl. ..... 58/38 R; 58/16.5; 58/19 R; 58/57.5

[58] Field of Search ..... 58/38, 57.5, 57, 16.5, 58/18, 19, 38 R, 152 B

[56] References Cited

U.S. PATENT DOCUMENTS 3,834,153 9/1974 Yoda et al. ..... 58/38

*Primary Examiner*—Edith S. Jackmon

*Attorney, Agent, or Firm*—Robert E. Burns; Emmanuel J. Lobato; Bruce L. Adams

[57] ABSTRACT

An electronic alarm timepiece having multi-channels for setting time wherein the time information of said channels is applied in a time sharing manner to a coincidence detecting circuit.

1 Claim, 1 Drawing Figure

ELECTRONIC TIMEPIECE HAVING AN ALARM DEVICE

BACKGROUND OF THE INVENTION

This invention relates to an electronic timepiece having an alarm device, particularly relates to the coinciding detecting means for detecting the coincided state of a contents of a set time and a contents of a time counting circuit.

In the conventional type of electronic alarm timepiece, the coincided state between of the counter of said time counting circuit and the set time of the memory circuit was always detected, therefore, the information of said time counting circuit and the information of said memory circuit were applied to the coinciding and detecting circuit whereby the coincided signal was generated.

In the above noted coinciding and detecting circuit system, it is necessary to prepare a plurality of coinciding and detecting circuits of corresponding to the number of the memory circuits in the electronic timepiece having alarm device capable of being set with a plurality of setting times for multichannels, whereby the circuit become to the complicated one.

BRIEF SUMMARY OF THE INVENTION

This invention aims to eliminate the above noted difficulty and insufficiency, the time informations of a plurality of channels are selected by a time sharing system during only the period of the time width of the output signal of being generated from the seconds counting circuit, whereby the power consumption is pressed to the low level. Further the coincidence detecting circuit construction is simplified. The coincided signal of the multichannels having a plurality of memory circuits is applied to the coinciding detecting circuitry by the operation of the timesharing system.

DETAILED DESCRIPTION OF THE INVENTION

Figure 1:
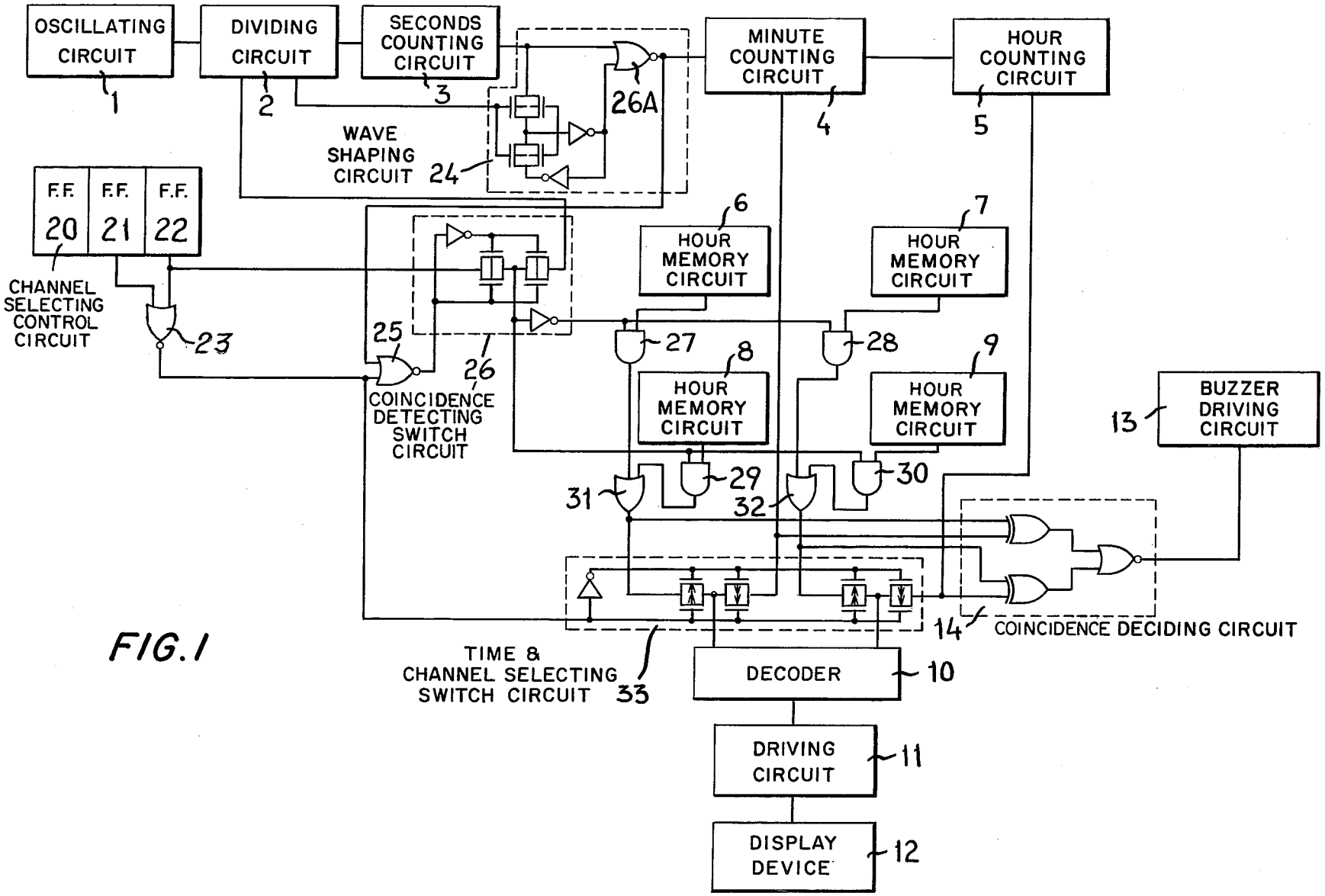
FIG. 1 shows the circuit construction for showing the electronic timepiece having alarm device.

In FIG. 1, the output signal of an oscillating circuit 1 having a quartz crystal element is applied to a dividing circuit 2, the output of said dividing circuit 2 is applied to a seconds counting circuit 3 whereby 1 minute signal is generated.

Said 1 minute signal is applied to the wave shaping circuit 24 of being composed of a latch circuit for obtaining the signal of narrow pulse width, the output of said wave shaping circuit 24 is applied to a minute counting circuit 4, the output of said minute counting circuit 4 is applied to a hour counting circuit 5 whereby the time is counted.

Further, the electronic timepiece of the present invention included a channel selecting controlling circuit of being composed of D-type flip flop circuit 20, 21 and 22, a coinciding detecting switch circuit 26 for selecting the coinciding detecting signal by the switch, a minute and hour memory circuits 6 and 7 for a first channel, a minute and hour memory circuits 8 and 9 for a second channel, a time sharing circuit of being composed of OR-circuits 31 and 32 and AND-circuits 27, 28, 29 and 30 for coinciding detecting the contents of said first channel and second channel by the time sharing system, a time and channel selecting switch circuit circuit 33 for displaying the contents of time or channel, a decoder 10 and driving circuit 11 for transferring a BCD signal to a segment signal, a display device 12 for displaying the contents of time or channel, a coinciding deciding circuit 14 for deciding the coincided state of the contents between the time and the set time, and a buzzer driving circuit 13 for generating the alarm signal by the coincided signal of said coinciding deciding circuit 14.

Referring now to the operation of the embodiment of the present invention:

D-type flip flop circuits 20, 21 and 22 consist the channel selecting controlling circuit of consisting the three ring counter, and of being controlled by the mechanical switch.

When the output of said D-type flip flop circuit 20 is maintained to "1" state, the outputs of the other D-type flip flop 21 and 22 is "0" state whereby the output of NOR-circuit 23 is maintained to "1" state. Said signal is the control signal of the time and channel selecting circuit 33 of being composed of the transmission-gate whereby the time contents is displayed to the display device.

When the output of said D-type flip flop circuit 20 is maintained to "0" state, the output of NOR-circuit 23 becomes to "0" state, whereby the contents of set time of the first channel or second channel are displayed to the display device. Therefore, referring now to the display condition of the contents of the second channel when the output of said D-type flip flop circuit 22 is maintained to "1" state:

The output "0" of NOR-circuit 23 is applied to NOR-circuit 25. The output of NOR-circuit 26 of said wave shaping circuit 24 is normally maintained to "0" state, the output of NOR-circuit 25 becomes to "1" state, said signal is the control signal of said coinciding detecting switch circuit 26. Whereby the output "1" of said D-type flip flop circuit 22 is applied to AND-circuits 29 and 30, the memory contents of the minute and hour setting circuits 8 and 9 are selectively displayed to said display device 12.

When the one minute signal from said seconds counting circuit 3 was applied to said wave shaping circuit 4, the signal 32Hz of the output stage of said dividing circuit 2 is employed as the control signal of said wave shaping circuit 4 whereby the output signal of NOR circuit 26A becomes to the pulse signal having a pulse width of 15msec. Therefor, the output of NOR-circuit 25 becomes to "0" state during 15msec, the opposite gate of said switch circuit 26 is opened whereby the output signal 128Hz from said dividing circuit 2 is generated. The contents of the first channel and the second channel are sampled by the time sharing system during 15msec, the output signal of being sampled is applied to said coinciding deciding circuit 14 whereby the coincidence to the time contents is decided. Said coinciding deciding circuit is composed of an exclusive OR-circuit and NOR-circuit, the buzzer is operated by the coinciding signal of said coinciding deciding circuit 14.

According to the present invention, it is not necessary to always detect the coincidence between the time and the set time. The set time is the figure of minute as the minimum unit, the coincidence is decided whenever the minute signal is generated, whereby the circuit construction is able to be simplified.

Further the time sharing operation is operated during only short period of the minute signal output whereby it is possible to decide the other coincidence when the channel is selectively displayed.

Further, in case of employing a liquid crystal display device as the display device, a shorter period than the down time of a liquid crystal is employed as the coinciding detecting time whereby a frickering is completely pressed.

Furthermore, in case of employing a LED display device, the coinciding detecting time is controlled within the after image time whereby the flickering is completely pressed.

I claim:

1. In an electronic timepiece: a plurality of memory circuits for storing selected alarm times; an alarm responsive to an enabling signal for developing an alarm signal; a coincidence detecting circuit for detecting coincidence between a signal representative of present time and the contents of respective ones of said memory circuits and for applying an enabling signal to said alarm when coincidence is detected; and means for applying the contents of said memory circuits to said coincidence detecting circuit in a time-sharing mode to permit said coincidence detecting circuit to compare all of the alarm time with present time.

* * * * *